US005970551A

United States Patent [19]

Allen

[11] Patent Number: 5,970,551

[45] Date of Patent: Oct. 26, 1999

[54] HIGH HEEL TOOL ASSEMBLY

[76] Inventor: Carol Ann Allen, 1887 Andrea Pl., Santa Clara, Calif. 95051

[21] Appl. No.: 09/040,138

[22] Filed: Mar. 17, 1998

[51] Int. Cl.[6] ..... A43D 5/00

[52] U.S. Cl. ..... 7/102; 7/143; 7/137

[58] Field of Search ..... 7/102, 137, 143, 7/167, 127; 81/490

[56] References Cited

U.S. PATENT DOCUMENTS

| | | | |
|---|---|---|---|
| 83,023 | 10/1868 | Barbarin | 7/102 |
| 133,383 | 11/1872 | Ober | 7/102 |
| 393,014 | 11/1888 | Knell | 7/102 |
| 864,153 | 8/1907 | Boltz | 7/143 |
| 1,203,366 | 10/1916 | Larbig | 7/127 |
| 1,411,970 | 4/1922 | Ligon | 7/167 |
| 1,748,673 | 2/1930 | Hurst | 7/133 |
| 4,741,059 | 5/1988 | Lee et al. | 7/143 |

FOREIGN PATENT DOCUMENTS

| | | | |
|---|---|---|---|
| 31065 | 5/1904 | Switzerland | 7/127 |

*Primary Examiner*—David A. Scherbel
*Assistant Examiner*—Joni B. Danganan
*Attorney, Agent, or Firm*—Goldstein & Canino

[57] ABSTRACT

A tool assembly for repairing high heel shoes comprises a hammer handle having opposite first and second ends, a hammer head securely mounted to said first end of the hammer handle, and an end cap releasably attached to the second end of the hammer handle for storing replacement heel taps. The end cap may be detached from the hammer handle and placed underneath a high heel shoe for serving as a shoe stand for the purpose of driving a replacement tap into the heel. The tool assembly further comprises pliers releasably attached between the hammer handle and the end cap for disengaging heel taps.

10 Claims, 2 Drawing Sheets

HIGH HEEL TOOL ASSEMBLY

BACKGROUND OF THE INVENTION

This invention relates to a high heel tool assembly. More particularly, the invention relates to a tool assembly which employs a hammer, pliers, an end cap, and replacement heel taps stored within the end cap designed for facilitating replacement of heel taps of high heel shoes.

Typical high heel shoes designed for women have a heel that includes an elongated slender shank and a small heel tap attached to the end thereof. Due to the smallness of the high heel taps, they are easily worn out and must be frequently replaced. However, going to the shoe repair store to have the heel taps replaced every time they wear out can be inconvenient and relatively expensive. Nonetheless, worn out heels should be replaced in a timely fashion, otherwise, excessively worn heels may cause damages to floors and may eventually result in irreparable damages to the shoes. Thus, it is desirable to have a device that will allow shoe wearers to conveniently replace worn out heel taps by themselves without the necessity of having the heel taps replaced at a shoe repair store.

A variety of different types of devices have been designed for removing worn out heel taps. For example, U.S. Pat. No. 5,448,816 to Hill discloses a device comprising a tool and support bracket which enables the tip of a high heel shoe to be removed. Likewise, U.S. Pat. No. 5,228,163 to Arzaghi discloses an apparatus which utilizes a hydraulic ratchet for removing the top lift and pin of high heel shoes. U.S. Pat. No. 2,992,445 to Nelson discloses a hand operated tool adapted for use in shoe repair shops to remove top lifts and heel mounting dowel pins from the heels of women's shoes.

Despite all these high heel repairing devices, there is still a further need to provide an improved high heel tool assembly. Such a tool assembly should be simple enough for any individual to operate, and yet contain all the necessary tools and replacement parts necessary to repair worn out heel taps. Moreover, such a tool assembly should be small enough to be easily carried around.

While these units mentioned above may be suitable for the particular purpose employed, or for general use, they would not be as suitable for the purposes of the present invention as disclosed hereafter.

SUMMARY OF THE INVENTION

It is an object of the invention to provide a high heel tool assembly which is simple enough for any individual to operate, and yet contains all the necessary tools and replacement parts necessary to repair a worn out heel taps.

It is another object of the invention to provide a high heel tool assembly which can be connected in the assembled configuration for easy storage and transport purposes.

It is yet another object of the invention to provide a high heel tool assembly which contains replacement heel taps so that they are readily available when a worn out heel tap has been removed and a replacement heel tap is necessary.

It is a further object of the invention to provide a high heel tool assembly which utilizes a feeler gauge and conversion inserts to bring the recess hole within the heel to one size.

The invention is a tool assembly for repairing high heel shoes comprising a hammer handle having opposite first and second ends, a hammer head securely mounted to said first end of the hammer handle, and an end cap releasably attached to the second end of the hammer handle for storing replacement heel taps. The end cap may be detached from the hammer handle and placed underneath a high heel shoe for serving as a shoe stand for the purpose of driving a replacement tap into the heel. The tool assembly further comprises pliers releasably attached between the hammer handle and the end cap for disengaging heel taps.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
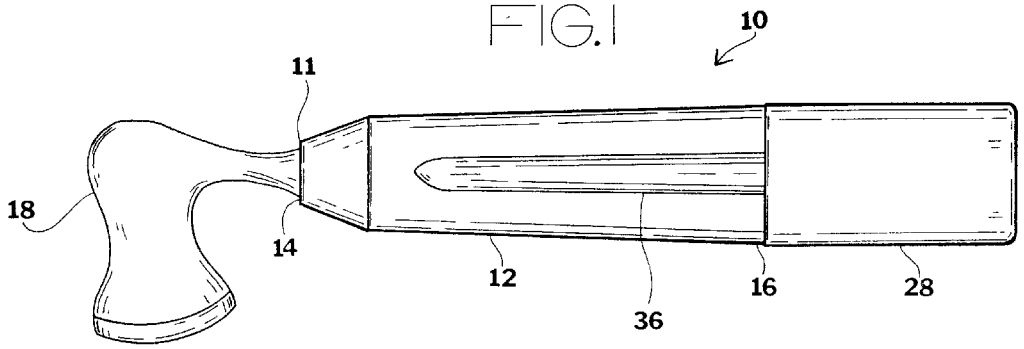
FIG. 1 is a side elevational view of the instant invention in assembled configuration for convenient storage and carrying purposes.
Figure 2:
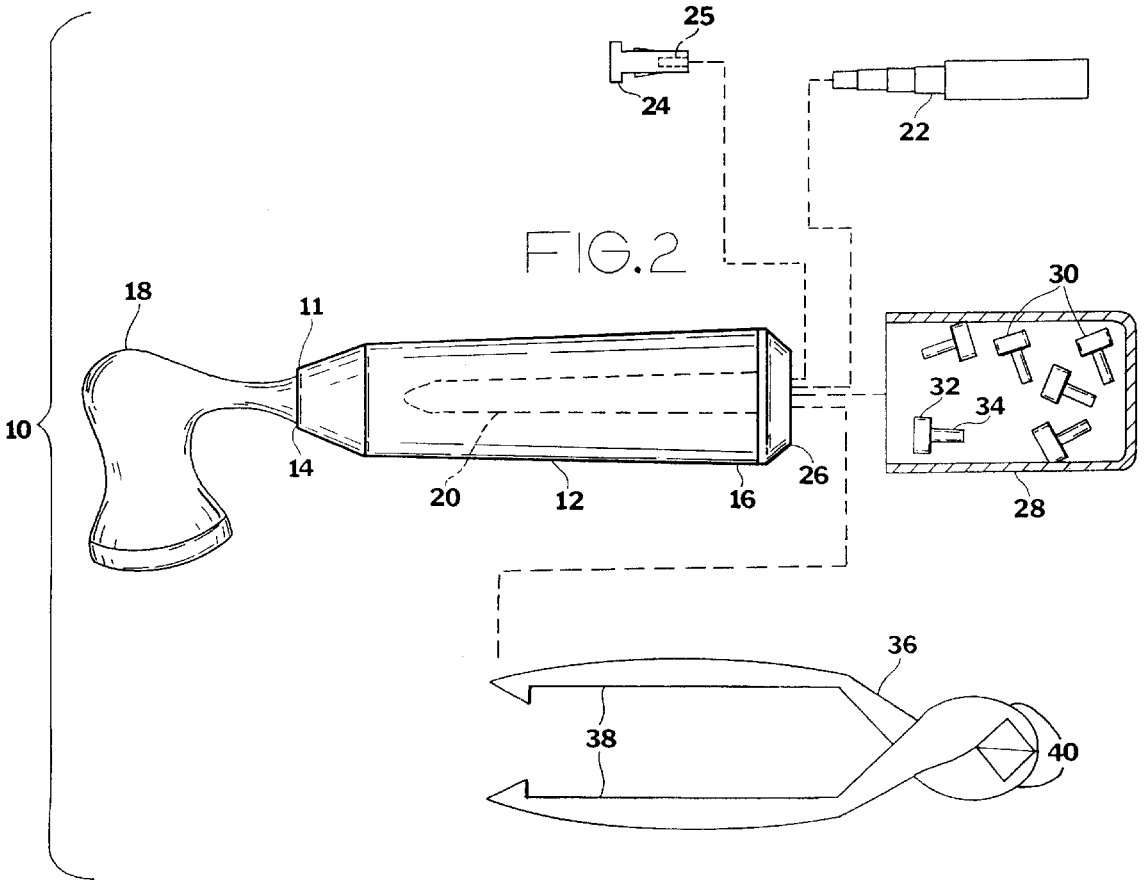
FIG. 2 is an exploded view of the instant invention with the end cap, the pliers, the feeler gauge, and a conversion insert detached from the hammer body.

FIG. 1 illustrates the high heel tool assembly 10 in an assembled configuration for convenient storage and carrying purposes. The high heel tool assembly 10 comprises a hammer 11 which includes a hammer handle 12 having opposite first 14 and second 16 ends, and a hammer head 18 securely mounted to the first end 14 of the hammer handle 12. FIG. 2 illustrates a hollow interior bore 20 extending through the length of the hammer handle 12 and terminating at an opening provided at the second end 16 of the hammer handle 12 for storing a feeler gauge 22 and conversion inserts 24, yet to be described. The hammer handle 12 is provided with a plug 26 for closing the opening therein.

The high heel tool assembly 10 further comprises a cylindrical shaped end cap 28 releasably attached to the second end 16 of the hammer handle 12 for storing replacement heel taps 30. Each replacement heel tap 30 includes a disc shaped portion 32 and a dowel 34. The end cap 28 includes a pair of latches on the inner surface thereof which cooperate with latch receiving means on the second end 16 of the hammer handle 12, which are not shown here, to hold the end cap 28 attached to the hammer handle 12.

Figure 3:
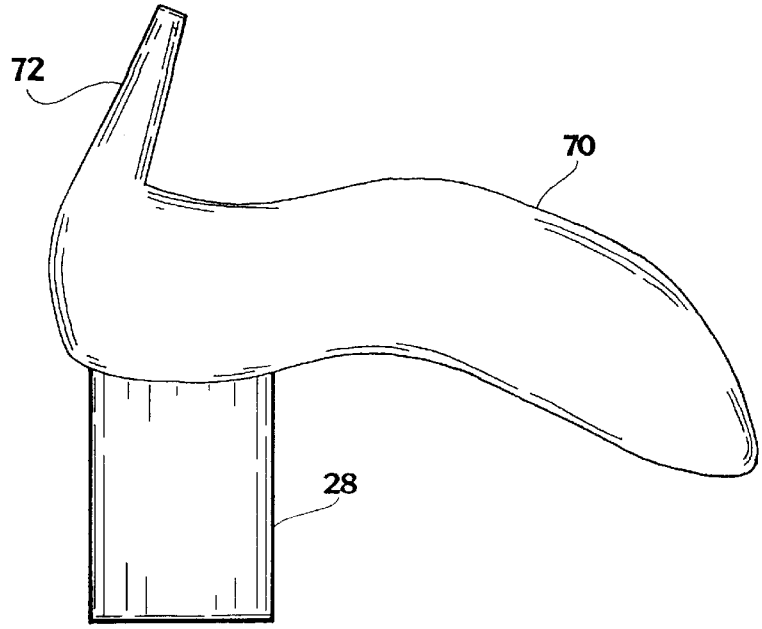
FIG. 3 is a side elevational view of a shoe placed on the end cap serving as a shoe stand for the purpose of driving a replacement tap into the heel.
Figure 4:
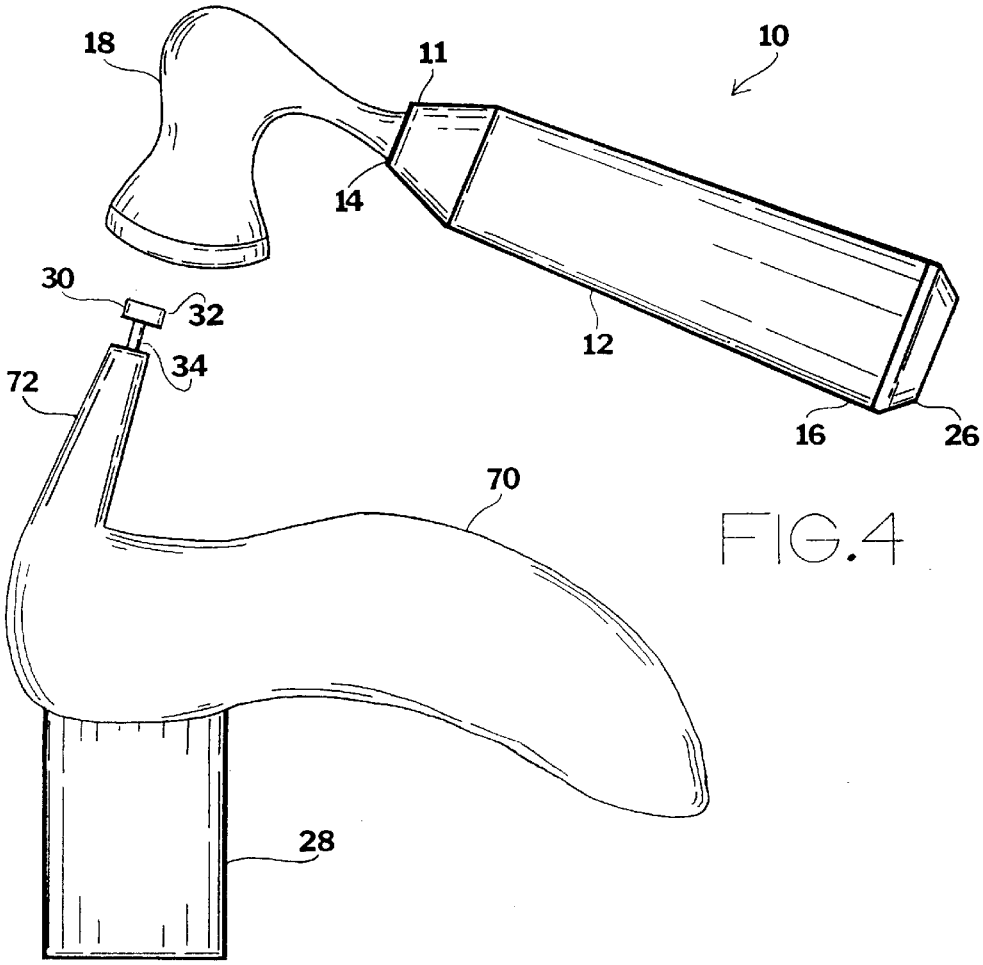
FIG. 4 is a side elevational view of the instant invention, illustrating the manner in which the high heel tool assembly is used to drive a replacement tap into the heel.

FIGS. 3 and 4 illustrate a high heel tool assembly 10 being used on a conventional high heel shoe 70. For a better understanding of the present invention, the high heel shoe 70 is illustrated consisting generally of a heel 72 that includes an elongated slender shank and a heel tap 30 attached to the end thereof. The end cap 28 may be detached from the hammer handle 12 and placed underneath the high heel shoe 70 so that the end cap 28 may served as a shoe stand for the purpose of driving a replacement heel tap 30 into the heel as viewed in drawings FIG. 3 and 4. The exterior diameter and length of the end cap 28 is selected so that the end cap 28 can easily fit into the back of the high heel shoe 70, and at the same time, provide adequate support for the back portion of the high heel shoe 70 while the hammer 11 is used to drive a replacement heel tap 30 into the heel 72.

Referring to FIG. 2, the high heel tool assembly 10 further comprises pliers 36, enlarged in FIG. 2 for clarity, which include a pair of swingable handles 38 integral with a pair of jaws 40 for disengaging heel taps 30. The hammer handle 12 has an exterior configuration which corresponds with the configuration of the pliers' handles 38 so that the pliers can be releasably secured thereto by latching the end cap 28 to the second end 16 of the hammer handle 12, as viewed in drawing FIGS. 1 and 2. In this way the high heel tool assembly 10 can be conveniently stored anywhere including car, office, home, or it can even be carried around.

Referring to FIGS. 2 and 4, the recess hole within the heel 72 for receiving the dowel 34 of the heel tap 30 vary in size between different high heel shoes. To bring the recess hole within the heel to one size, the high heel tool assembly 10 provides the tubular shaped conversion inserts 24 and the feeler gauge 22 which are conveniently stored within the hollow interior bore 20 of the hammer handle 12. Each tubular shaped conversion insert 24 has a bore 25 for receiving the dowel 34 of the heel tap 30. The conversion inserts 24 are provided in a wide variety of sizes for accommodating different high heel shoes with different recess hole sizes. To assist in selecting an appropriate conversion insert 24, the feeler gauge 22 may be used to quickly determine the appropriate size conversion insert 24 to use. The feeler gauge 22 and the conversion inserts 24 are preferably color coded for ease of use.

The tool assembly 10 of the present invention may be used for the replacement of worn out heel taps with a new heel tap, when necessary. The pliers 36 are used in conjunction with the hammer 11 to disengage the heel taps from the high heel shoes. First, the heel tap is firmly grasped between the jaws 40 of the pliers 36. After a proper grip is achieved, the hammer 11 is used to strike the pliers 36 with a sufficient force to cause the heel tap to be disengaged from the shoe. To assist in driving a replacement heel tap 30 into the heel 72, the high heel shoe 70 is placed on the end cap 28, as depicted in FIGS. 3 and 4. An appropriate conversion insert 24 is selected using the feeler gauge 22 to determine the appropriate size to use. The selected conversion insert 24 is first inserted within the recess hole within the heel 72 for receiving the dowel 34 of the heel tap 30. A replacement heel tap 30 is then hammered into the heel 72 within the bore 25 of the conversion insert 24,.

While the preferred embodiments of the present invention are described herein as being primarily a tool for repairing high heel shoes, it should be appreciated by those skilled in the art that the high heel tool assembly 10 may be utilized for other purposes where use of a hammer, pliers, and replacement parts are necessary.

Many specific details contained in the above description merely illustrate some preferred embodiments and should not be construed as a limitation on the scope of the invention.

What is claimed is:

1. A tool assembly for replacement of heel taps of high heel shoes, comprising:

a) a hammer including a hammer handle having opposite first and second ends, and a hammer head securely mounted to said first end of the hammer handle;

b) an end cap releasably attached to the second end of the hammer handle;

c) pliers including a pair of swingable handles integral with a pair of jaws, said pliers releasably attached to the hammer handle; and d) replacement heel taps stored within the end cap.

2. The tool assembly of claim 1, wherein the end cap has an exterior diameter and length which are selected so that the end cap can serve as a shoe stand providing support for the high heel shoe while the hammer is used to drive a replacement heel tap into the shoes.

3. The tool assembly of claim 2, wherein the hammer handle has an exterior configuration which corresponds with the pliers so that the pliers can be releasably secured thereto when the end cap is attached to the second end of the hammer handle.

4. The tool assembly of claim 3, further comprising conversion inserts stored within the hammer handle, each of said conversion inserts having a bore for receiving the heel tap.

5. The tool assembly of claim 4, further comprising a feeler gauge, stored within the hammer handle, for determining the appropriate conversion insert size to use.

6. The tool assembly of claim 5, wherein the conversion inserts and the feeler gauge are color coded for ease of use.

7. The tool assembly of claim 6, wherein the hammer handle further comprises a hollow interior bore for storing the conversion inserts and the feeler gauge.

8. A method of using a high heel tool assembly, for securely mounting a heel tap having a dowel into a high heel shoe having a heel and a recess hole within said heel, with a tool assembly comprising a feeler gauge, and a plurality of conversion inserts provided in a wide variety of sizes for accommodating different high heel shoes with different recess hole sizes, said each conversion insert having a bore for receiving said dowel of the heel tap, comprising the steps of:

a) using said feeler gauge to determine the appropriate size conversion insert to use;

b) inserting said selected conversion insert within said recess hole within the heel; and c) hammering said heel tap into the heel within the bore of the inserted conversion insert.

9. A method of using a high heel tool assembly as recited in claim 8, wherein the tool assembly further comprises a hammer, and an end cap releasably attached to the hammer, and wherein the feeler gauge and the conversion inserts are stored within the hammer, and replacement heel taps stored within the end cap, further comprising the steps of:

a) removing said feeler gauge from the hammer prior to using the feeler gauge to determine the appropriate size conversion insert to use;

b) removing the appropriate size conversion insert from the hammer prior to inserting the selected conversion insert within the recess hole within the heel; and c) removing the replacement heel tap from the end cap prior to hammering the heel tap into the heel within the bore of the inserted conversion insert.

10. A method of using a high heel tool assembly, for replacing a worn out heel tap of a high heel shoe with a replacement heel tap, with a tool assembly comprising a hammer, an end cap releasably attached to the hammer, pliers releasably attached to the hammer, and a plurality of replacement heel taps stored within said end cap, comprising the steps of:

a) removing said worn out heel tap from the high heel shoe using the hammer and the pliers;

b) detaching said end cap from the hammer;

c) placing said end cap underneath the high heel shoe such that the end cap may serve as a shoe stand; and d) hammering said replacement heel tap into the high heel shoe.

* * * * *